US006909671B2

(12) United States Patent
Setler

(10) Patent No.: US 6,909,671 B2
(45) Date of Patent: Jun. 21, 2005

(54) TIME COMPUTING DEVICE AND PREDICTIVE METHOD THEREFOR

(76) Inventor: Charles G. Setler, R.R. 2, Box 261J, Kistler Dr., Export, PA (US) 15632

( * ) Notice: Subject to any disclaimer, the term of this patent is extended or adjusted under 35 U.S.C. 154(b) by 370 days.

(21) Appl. No.: 10/197,741

(22) Filed: Jul. 18, 2002

(65) Prior Publication Data

US 2004/0013045 A1 Jan. 22, 2004

(51) Int. Cl.[7] ..... G04F 10/00
(52) U.S. Cl. ..... 368/113; 368/110
(58) Field of Search ..... 368/10, 11, 107–113

(56) References Cited

U.S. PATENT DOCUMENTS 4,285,041 A * 8/1981 Smith ..... 482/3
4,387,437 A 6/1983 Lowrey et al.
4,640,624 A * 2/1987 Pitt ..... 368/111
4,831,605 A * 5/1989 Suga ..... 368/113
4,993,004 A 2/1991 Loizeaux
5,151,885 A 9/1992 Kasuo
5,297,110 A 3/1994 Ohira et al.
5,301,154 A * 4/1994 Suga ..... 368/10
5,404,341 A 4/1995 Horiguchi
5,408,446 A * 4/1995 Ohira ..... 368/110
5,513,103 A * 4/1996 Charlson ..... 700/93
5,526,290 A * 6/1996 Kanzaki ..... 702/160
5,812,049 A 9/1998 Uzi

* cited by examiner

*Primary Examiner*—Randy Gibson
*Assistant Examiner*—Thanh S. Phan
(74) *Attorney, Agent, or Firm*—Webb Ziesenheim Logsdon Orkin & Hanson, P.C.

(57) ABSTRACT

A time computing device including an actuator mechanism for actuating a timer mechanism, which outputs elapsed time quantity. The actuator mechanism provides selection inputs corresponding to race total distance quantity and split number quantity. A central control mechanism is in communication with the actuator mechanism and sets a split distance increment and performs calculations resulting in a split time, a predicted split time and a predicted race finishing time. The time computing device includes a display mechanism for visually displaying actuator mechanism inputs and computational results. A predictive method is also disclosed.

26 Claims, 3 Drawing Sheets

TIME COMPUTING DEVICE AND PREDICTIVE METHOD THEREFOR

BACKGROUND OF THE INVENTION

1. Field of the Invention

The present invention relates generally to time computing devices, such as clocks, wristwatches, stopwatches and the like, and, in particular, to a time computing device and predictive method for determining a user's predicted race finish time.

2. Description of Related Art

Racing, whether car racing or foot racing, is a popular pastime in sport throughout the world. Typically, runners in organized foot races set specific time goals for finishing the race. These goals require that a certain pace be maintained as a target pace, and a runner will adjust his or her speed in an attempt to reach the specified time goal. Race officials typically help in this regard by calling out the elapsed time as runners reach certain intermediate distances, often referred to as splits, for instance, each three kilometers or each mile. Runners may then attempt to determine if they are maintaining their target pace and adjust their speed accordingly.

The process of adjusting pace and attempting to reach a goal in a race requires that certain mathematical operations be carried out in the racer's head. This proves especially difficult in the countries, such as the United States of America, where the convention is to use miles as the intermediate distances or split distances, even for those races which are an even number of kilometers, for example, a 5K, 10K, etc. Runners engaged in races set in kilometers would, for example, have to maintain a pace of seven minutes, fifty seconds per mile in order to finish the 10K race in forty-eight minutes and forty seconds. In this example, after finishing mile three, the runner is told that he has been running for twenty-five minutes and forty-one seconds. The runner must then determine in his head whether he is on target. In certain prior art methods, some runners may calculate in advance what their target times should be for two miles, three miles, etc., and commit these target times to memory. Further, some runners may even write these target times on their hand. However, even if the runner in the example is able to remember that he should have run the first three miles in twenty-three minutes and thirty seconds, he is therefore two minutes and eleven seconds behind his target. What does this imply about his finishing time? If he is able to run his target pace for the remainder of the race, he would obviously finish two minutes and eleven seconds behind his goal. However, if he is able only to maintain the pace he has averaged for the first three miles, he will finish in fifty-three minutes and twelve seconds, namely four minutes and thirty-two seconds behind his target. This type of calculation, which proves important to the runner, is virtually impossible to do in one's head.

In order to pace oneself, a runner may use a stopwatch, including electronic models which have the ability to measure and record split times upon the operation of a push button as the split distance is reached. These stopwatches or time measurement devices may calculate typical desired time readings, such as lap times, cumulative times, split times, average times, required times, distance histories and multiple participant times. For example, see U.S. Pat. No. 4,640,624 to Pitt; U.S. Pat. No. 4,831,605 to Suga; U.S. Pat. No. 5,151,885 to Kasuo; U.S. Pat. No. 5,404,341 to Horiguchi; and U.S. Pat. No. 5,812,049 to Uzi.

There are also devices in the prior art that measure the number of strides a runner takes, therefore displaying the runner's progress through a race course. Certain devices have been developed which calculate desired time measurements based upon passive or active interaction with the runner's body. For example, see U.S. Pat. No. 4,387,437 to Lowrey et al.; U.S. Pat. No. 4,993,004 to Loizeaux; and U.S. Pat. No. 5,301,154 to Suga.

Other devices have been developed, which include time calculations with certain predictive functionality. Also known are devices which indicate to a runner the rate at which he should be striding in order to maintain a target pace. For example, U.S. Pat. No. 4,285,041 to Smith describes a pacemaker in which the target stride rate may be adjusted based upon performance during the race and earlier splits. Other examples of these devices are seen in U.S. Pat. No. 5,297,110 to Ohira et al.; U.S. Pat. No. 5,408,446 to Ohira; and U.S. Pat. No. 5,526,290 to Kanzaki. Further, time measurement devices have been developed which employ the Global Positioning System (GPS) technology, and are used to indicate distance covered and rate of speed since the start of a race or a split distance covered.

However, presently there are no devices or methods for these devices which would enable a runner to input a certain race total distance, for example a 5K or a 10K, and use his or her progress through the race and through the splits to predict the most valuable piece of information to the runner, namely, his or her finishing time.

SUMMARY OF THE INVENTION

Accordingly, it is an object of the present invention to provide a time computing device and predictive method that overcome the deficiencies of the prior art devices and methods. It is another object of the present invention to provide a time computing device and predictive method for predicting a race finishing time. It is another object of the present invention to provide a time computing device and predictive method that are easy to program and operate while a runner is engaged in a race. It is yet another object of the present invention to provide a time computing device and predictive method which are able to predict a race finish time based upon a runner's average split times.

The present invention is directed to a computer-implemented predictive method for a race finishing time, RFT, and includes the steps of: (a) setting a race total distance quantity, TD; (b) setting a split distance increment, SDI; (c) actuating a running timer mechanism outputting an elapsed time quantity, T; (d) inputting a split number quantity, SN, upon reaching a split distance increment, SDI; (e) computing a split time, ST, for each split number quantity, SN, and each split distance increment, SDI; (f) calculating an average split time, AST, based upon the elapsed time quantity, T, and the split number quantity, SN; (g) setting a most recent split time, MRST, equal to the split time, ST; (h) calculating a predicted split time, PST, based upon at least one of the average split time, AST, and the most recent split time MRST; and (i) predicting the race finishing time, RFT, based upon the total distance quantity, TD, the split distance increment, SDI, the elapsed time quantity, T, the split number quantity, SN, at least one of the predicted split times, PST, and the average split time, AST. In a preferred embodiment, the race finishing time, RFT, is calculated using the formula:

$$RFT=T+\{[TD-(SN-1)\times SDI]\times(PST/SDI)\}.$$

The present invention is also a time computing device, which includes an actuator mechanism for actuating a timer mechanism, which outputs an elapsed time quantity, T, and provides at least one selection input corresponding to a race total distance quantity, TD, and/or a split number quantity, SN. A central control mechanism is in communication with the actuator mechanism and sets a split distance increment, SDI, and computes; (i) a split time, ST, for each split number quantity, SN, at each split distance increment, SDI; (ii) an average split time, AST, based upon the elapsed time quantity, T, and the split number quantity, SN; (iii) a most recent split time, MRST, based upon the current split time, ST; (iv) a predicted split time, PST, based upon at last one of the average split time, AST, and the most recent split time, MRST; and (v) a predicted race finishing time, RFT, based upon the total distance quantity, TD, the split distance increment, SDI, the elapsed time quantity, T, the split number quantity, SN, at least one of the predicted split time, AST, and the average split time, AST. In addition, the time computing device includes a display mechanism in communication with the central control mechanism for visually displaying the actuator mechanism inputs and/or computational results. The time computing device may be in the form of a wristwatch, a stopwatch, a clock, a hand-held computing device, and/or a portable computing device.

The present invention, both as to its construction and its method of operation, together with the additional objects and advantages thereof, will best be understood from the following description of exemplary embodiments when read in connection with the accompanying drawings.

DETAILED DESCRIPTION OF THE PREFERRED EMBODIMENTS

Figure 1:
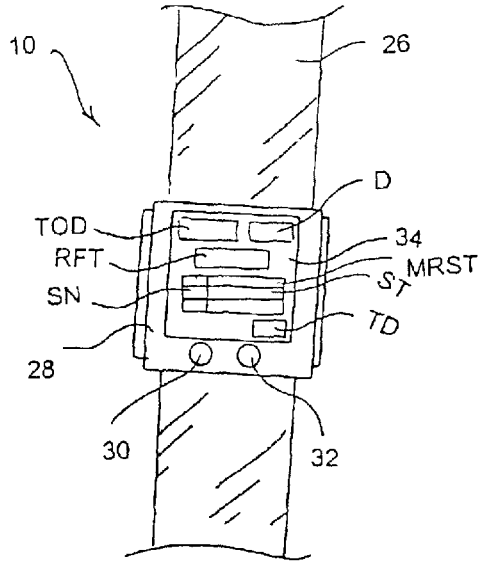
FIG. 1 is a front view of a time computing device according to the present invention.
Figure 2:
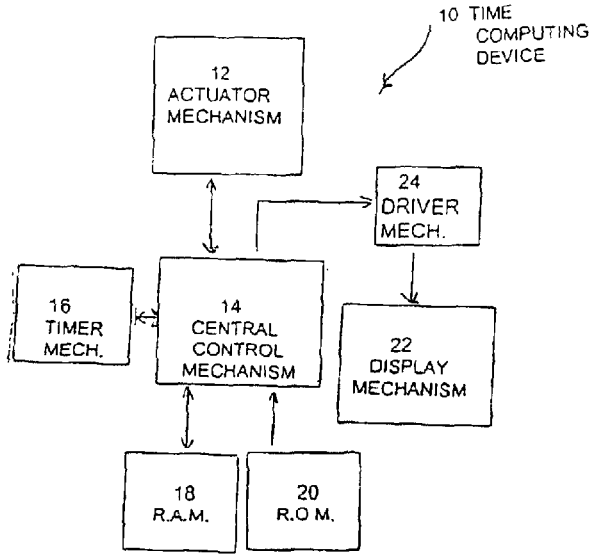
FIG. 2 is a schematic diagram illustrating the communication process between various components of the time computing device of FIG. 1.

The present invention is a time computing device 10 and is illustrated in FIGS. 1 and 2. Specifically, as seen in FIG. 2, the time computing device 10 includes an actuator mechanism 12, which is in communication with a central control mechanism 14. This actuator mechanism 12 actuates a timer mechanism 16, which is also controlled by the central control mechanism 14. The timer mechanism 16 transmits a signal, in the form of an input or interrupt, to the central control mechanism 14 at a fixed frequency, for example 100 times per second. In essence, this actuates the central control mechanism 16, such that it can count or add these signals and serve as a clock. The actuator mechanism 12, which could be one or multiple pushbuttons, switches, keypads, etc., provides data from the user to the central control mechanism 14. For example, the actuator mechanism 12 may provide the ability for the user to select inputs, which correspond to a race total distance quantity, TD, and/or a split number quantity, SN.

The central control mechanism 14 is capable of performing various computational activities and calculations, based upon inputs from the actuator mechanism 12 and the timer mechanism 16. In the preferred embodiment, the central control mechanism 14 has access to and is in communication with a random access memory 18 and a read only memory 20. These memories are used in a typical manner as is well known in the art, where the random access memory 18 allows memory values to be adjusted and moved in and out of the random access memory 18, and the read only memory 20 has set and predetermined values, which are only readable from the read only memory 20.

In this preferred embodiment, the central control mechanism 14 is able to set a split distance increment, SDI, and calculate a split time, ST, a predicted split time, PST, and a predicted race finishing time, RFT. The split time, ST, is computed or accumulated for each split number quantity, SN, at each split distance increment, SDI, based upon the elapsed time quantity, T. In this embodiment, the predicted split time, PST, is an average split time, AST. The average split time, AST, is based upon the elapsed time quantity, T, and the split number quantity, SN. Finally, the predicted race finishing time, RFT, is based upon the total distance quantity, TD, the split distance increment, SDI, the elapsed time quantity, T, the split number quantity, SN and, in this embodiment, the average split time, AST.

The time computing device 10 also includes a display mechanism 22, which is in communication with the central control mechanism 14 and visually displays inputs or selectable choices from the actuator mechanism 12 and/or computational or calculational results from the central control mechanism 14. It is also envisioned that the time computing device 10 includes sound capabilities and an associated speaker, from which certain sound may emanate and indicate certain values or calculational results.

In the preferred embodiment, the time computing device 10 includes a driver mechanism 24 in communication with both the central control mechanism 14 and the display mechanism 22. This driver mechanism 24 formats information communicated from the central control mechanism 14 for visual display in the display mechanism 22. Although the time computing device 10 may take the form of a wristwatch, a stopwatch, a clock, a hand-held computing device, a portable computing device, etc., in a preferred embodiment, the time computing device 10 is in the form of a runner's wristwatch, as illustrated in FIG. 1. In this preferred embodiment, the time computing device 10 includes a wristband 26 attached to a housing 28, which contains the central control mechanism 14, the timer mechanism 16, the random access memory 18, the read only memory 20 and the driver mechanism 24. In this embodiment, the actuator mechanism 12 is in the form of a first switch 30 and a second switch 32. Both the first switch 30 and the second switch 32 are in communication with the central control mechanism 14 via the actuator mechanism 12. Further, both the first switch 30 and the second switch 32 take the form of a push-button, which is capable of being pushed or plunged by a user.

Additionally, in this embodiment, the display mechanism 22 includes a screen 34, which is visible to the runner. It is envisioned that the screen 34 may also have an internal light source (not shown), which serves to illuminate the screen 34 in darkened conditions. For example, a light may shine on the screen 34 when one or both of the first switch 30 and the second switch 32 are actuated. In general, this embodiment of the time computing device 10 includes all of the functionality and structure of a typical wristwatch.

While the time computing device 10 may display any information on the screen 34, in this preferred embodiment, the time computing device 10 displays a runner's pace or split time, ST, for each split number quantity, SN. Also, the time computing device 10 could display the predicted race finishing time, RFT, for the entire race. As the next and succeeding split distance increments, SDI, are reached, previous split times, ST, a most recent split time, MRST, and split number quantity, SN, with an updated predicted race finishing time, RFT, may be displayed. In addition, the time computing device 10 may display the time-of-day, TOD, and/or the date, D. Of course, it is envisioned that this screen 34 could display any of the information desired and in any format, as set by the user. For example, the screen 34 may display the race total distance quantity, TD, which would identify the race the runner is engaged in.

The screen 34 may be covered by a transparent face and the screen 34 may be a typical liquid crystal display. In the preferred embodiment, the central control mechanism 14 controls operations of the various other mechanisms in communication therewith in accordance with a microprogram stored in the read only memory 20. This central control mechanism 14 is able to perform various processes, such as calculating the elapsed time quantity, T, and predicting the race finishing time, RFT. The random access memory 18 typically holds the program variables. The timer mechanism 16 (a clock circuit) uses an oscillator to trigger the operation of a subroutine by the central control mechanism 14. In addition, the actuation of either the first switch 30 or the second switch 32 triggers subroutines in the central control mechanism 14. The driver mechanism 24 formats information for the display mechanism 22, and such liquid crystal display drivers and devices are in common use in connection with digital wristwatches and stopwatches. Many of the separate mechanisms hereinabove described may be integrated into a single circuit, as is well known in the field.

In the preferred embodiment, the race total distance quantity, TD, is presented to the user on the display mechanism 22 in a user-selectable race menu format. For example, this user-selectable menu may have certain choices of typical race lengths, such as five kilometers, five miles, ten kilometers, fifteen kilometers, half-marathon and/or marathon. However, it is envisioned that the race total distance quantity, TD, can be in this user-selectable format, or may also be configurable or predetermined.

Figure 3:
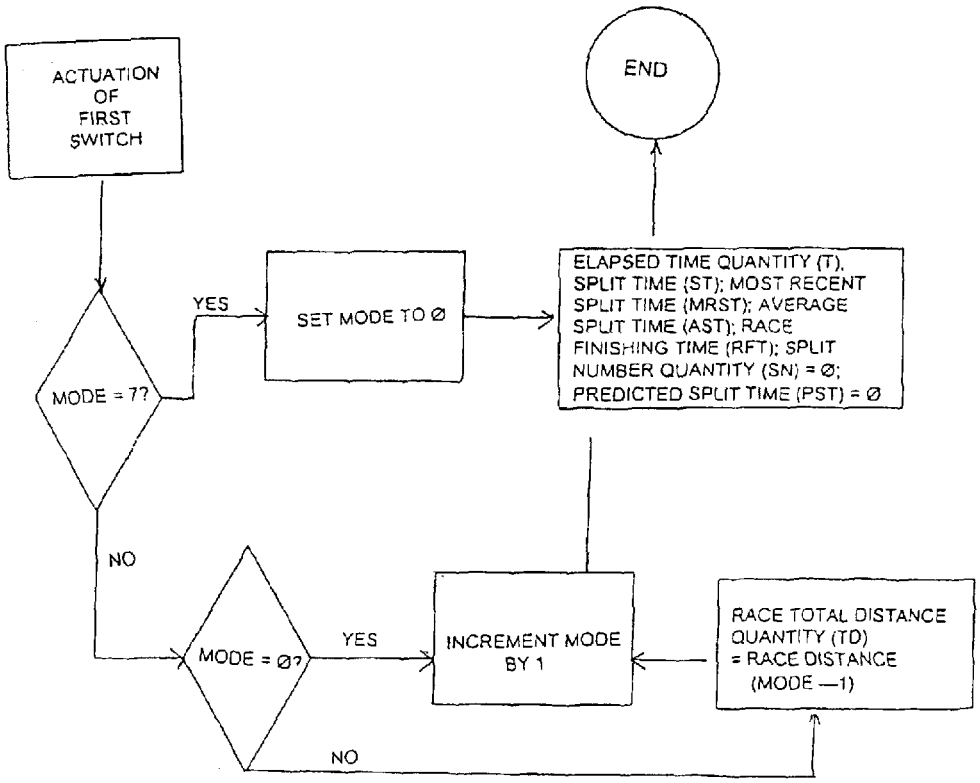
FIG. 3 is a flow diagram of a subroutine of a preferred embodiment of the predictive method according to the present invention.

As shown in FIG. 3, when the first switch 30 is actuated, a subroutine is enacted by communication between the central control mechanism 14, the timer mechanism 16, the random access memory 18, and the read only memory 20. Each time the first switch 30 is actuated, this subroutine advances to the next of several different operating modes, and, if encountering the last operating mode, to begin again with the first operating mode. In this embodiment, the first mode is a "set time" mode and is used to set the correct time-of-day, TOD. This mode may also be used to set the date, D. The second mode is a standard time-of-day and date watch, displaying the time-of-day, TOD, and date, D, on the screen 34. The remaining modes correspond to the various total distances which might be run in a road race. As discussed above, races in the United States typically include the 5K, the 5 mile, the 10K, the 15K, the half-marathon and the marathon.

As shown in FIG. 3, when the first switch 30 is actuated, if the mode is set to seven, its highest value, the central control mechanism 14 sets the mode to zero, which is the "set time" mode. The program then ends with setting a series of internal variables to zero, namely the elapsed time quantity, T, the split time, ST, a most recent split time, MRST, the average split time, AST, the race finishing time, RFT, and the split number quantity, SN. However, if the mode is zero, the mode is advanced by one and internal variables are then cleared to zero, as discussed above.

If the mode is at settings one through six, the program establishes a value for the race total distance quantity, TD. The value is chosen from a table stored in the read only memory 20. Each different version or model of the time computing device 10 may have a unique set or menu of distances, in meters, which will correspond to the most popular races in the country or region. In this preferred embodiment, the table is as follows:

| MODE-1 | RACE TOTAL DISTANCE QUANTITY (TD) | RACE |
|---|---|---|
| 0 | 5000 | 5 Kilometers |
| 1 | 8046.5 | 5 Miles |
| 2 | 10000 | 10 Kilometers |
| 3 | 15000 | 15 Kilometers |
| 4 | 21051.2 | Half-Marathon |
| 5 | 41841.8 | Marathon |

The central control mechanism 14 then increments the mode by one and clears the internal variables, as discussed above, before halting the process. As discussed in detail hereinafter, all display functions are managed by the clock subroutine, but, to the observer or user, the screen 34 would change immediately upon operation of the first switch 30.

Figure 4:
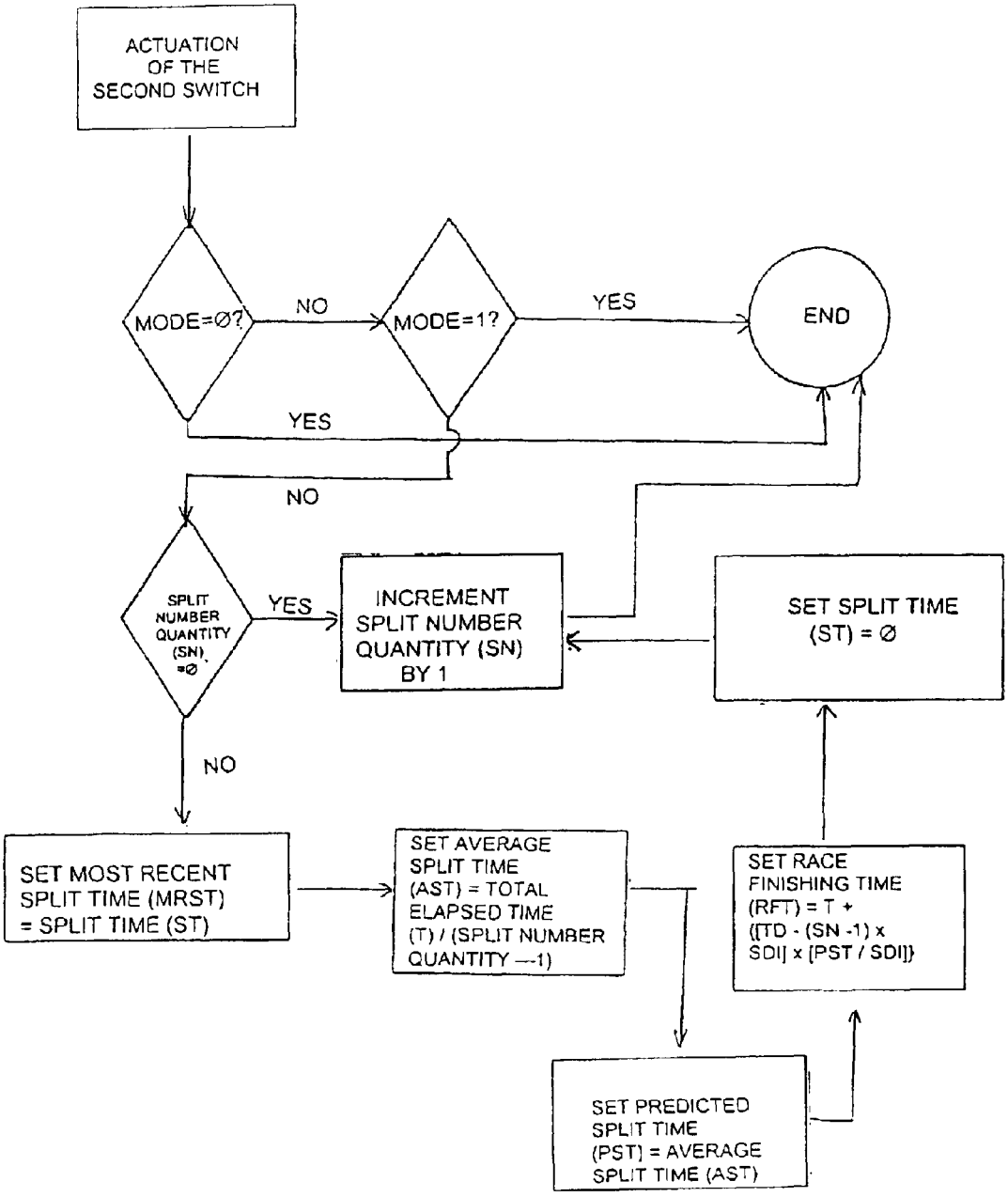
FIG. 4 is a flow diagram of a second subroutine of the predictive method according to the present invention.

A subroutine, which is executed each time the second switch 32 is actuated, is illustrated in FIG. 4. Operating the second switch in the "time-of-day" mode has no effect. In the "set time" mode, operating and continuing to hold the second switch 32 causes the time-of-day, TOD, to advance (to set the correct time). In all other modes, the second switch 32 is operated at the start of the race and as each split distance increment, SDI, is reached. As seen in FIG. 4, after actuation of the second switch 32, the time computing device 10 determines whether it is currently in the "set time" or "time-of-day" mode. If it is, it ends without further activity. Again, as discussed hereinafter, the clock subroutine detects if the second switch 32 is operated and held while in the "set time" mode. If the mode is 2–7, and the split number quantity, SN, is zero, the operation or actuation of the second switch 32 signals that the race has begun. The split number quantity, SN, is then set to one, which will signal the "clock" subroutine to begin accumulating time. If the mode is 2–7 and the split number quantity, SN, is greater than zero, the operation or actuation of the second switch 32 signals that a split distance increment, SDI, has been reached. The value which has been accumulated in the split time, ST, is transferred to the most recent split time, MRST, variable. The predicted split time, PST, for the remainder of the race, in this case, equal to the average split time, AST, is then calculated. Next, the race finishing time, RFT, is calculated using the following formula:

$$RFT=T+\{[TD-(SN-1)\times SDI]\times(PST/SDI)\}$$

Again, the elapsed time quantity, T, is the time consumed so far in the race, race total distance quantity, TD, is the total distance to be run in the race, split number quantity, SN, is the number of the split being run, one greater than the number of distances reached, split distance increment, SDI, is the incremental length of an individual split, average split time, AST, is the average time for the splits reached so far in the race, and predicted split time, PST, is the calculated and predicted time to finish a split distance increment, SDI.

Typically, the split distance increment, SDI, is a value stored in the read only memory 20. Each version or model of the time computing device 10 has a value for the split distance increment, SDI, which matches the convention for that country or region. For example, in the United States, split distances are exactly one mile, hence the value stored would be 1609.3 (meters).

This formula for predicting the race finishing time, RFT, assumes that a runner's average speed up to any point in a race is the best predictor of the speed to be realized for the remainder of the race. However, other embodiments might instead give more weight to recent performance and determine the predicted split time, PST, utilizing the most recent split time, MRST. For example, the following formula may be used:

$$PST=[(WF\times AST)+MRST]/(WF+1)$$

A weighting factor, WF, is a value chosen by the device 10 manufacturer or, possibly the user of the device 10. The weighting factor, WF, would be given a value which that manufacturer/user thinks best predicts finishing performance. The higher the number chosen for the weighting factor, WF, the less the most recent split time, MRST, is given consideration. For instance, consider if the weighting factor, WF, was set to 20,000. The predicted split time, PST, would equal (20,000AST+MRST)/20,001. In this case, the average split time, AST, will account for 20,000 times as much as the most recent split time, MRST. In effect, we are back to the preferred embodiment, where the predicted split time, PST, equals the average split time, AST. However, in a case where the weighting factor, WF, would be set to 3, the predicted split time, PST, would equal (3AST+MRST)/4. While the average split time, AST, is still the primary predictive factor, the time for the most recent split time, MRST, is now starting to be more important in predicting the times for future splits. For example, if the runner is tiring, and the most recent split time, MRST, is significantly longer than the average split time, AST, the formula will now reflect that the future pace will be less than the average split time, AST, has been to this point. It is envisioned that more sophisticated embodiments may store many or all realized split times and use a curve-fitting logic to predict the pace for the remainder of the race, including some or all of the realized split times, ST. Such a logic program can be stored in the read only memory 20 and executed by the central control mechanism 14. Finally, returning to FIG. 4, the split time, ST, is set to zero so that it may begin to accumulate the time for the split being started.

Figure 5:
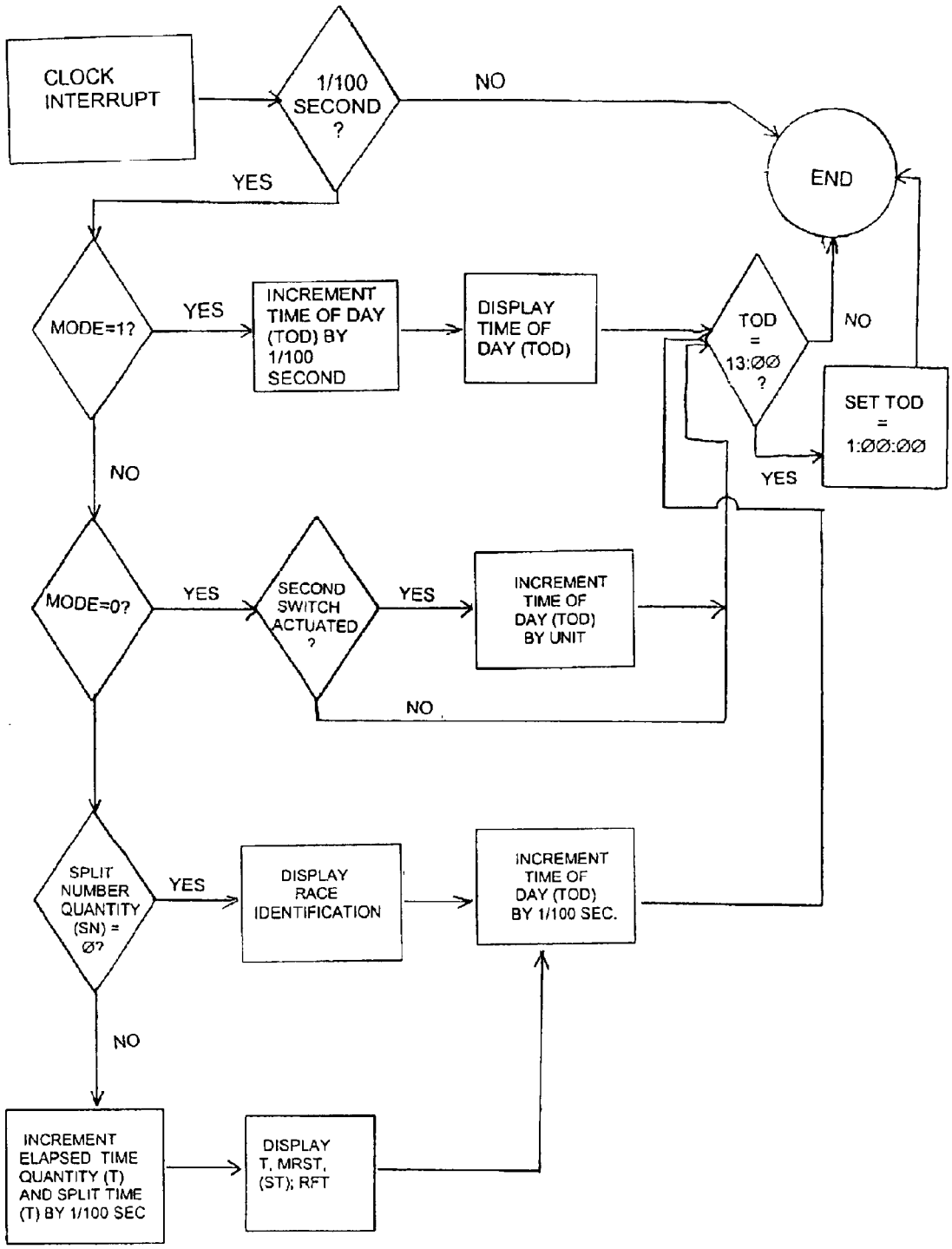
FIG. 5 is a flow diagram of a clock subroutine of the predictive method according to the present invention.

FIG. 5 illustrates the "clock" subroutine, which is triggered with each clock interrupt. This clock interrupt occurs on the timer mechanism 16 as controlled by the central control mechanism 14. The role of the subroutine is to accumulate time in several time variables and to manage all display functions. The subroutine allows for high clock circuit frequencies. Until 1/100 second has elapsed, the remainder of the subroutine is not run. The interval 1/100 second is chosen as it is the typical resolution of a digital display time variable. If the mode is equal to 1 ("time-of-day" mode), the variable time-of-day, TOD, is incremented by 1/100 second. Next, the time-of-day, TOD, is displayed upon the watch face or screen 34.

If the mode is equal to zero ("set time" mode), the subroutine checks to see if the second switch 32 is being actuated. If it is, the variable time-of-day, TOD, is incremented at an adjusted rate, which typically increases the clock speed. This is a typical approach to setting the time in a preferred embodiment. However, any manner of setting the correct time-of-day, TOD, is envisioned. For example, other embodiments may employ more complex methods, such as the familiar separate setting of hours and minutes.

In all other modes, namely 2–7, the subroutine checks to see if the race has begun, that is, whether the split number quantity, SN, is not equal to zero. If the race is not started, the program displays the correct race identification on the screen 34. The race identification is drawn from a set of names stored in the read only memory 20. Each name corresponds with a distance stored in the race total distance quantity, TD, variable and previously described in connection with the first switch 30. In this preferred embodiment, the race identification variable shown on the screen 34 may appear as follows:

| MODE | NAME |
|---|---|
| 0 | N/A |
| 1 | N/A |
| 2 | 5 K |
| 3 | 5_MILE |
| 4 | 10 K |
| 5 | 15 K |
| 6 | HALF_M |
| 7 | MARATH |

Therefore, this subroutine ensures that until the race begins, the display or screen 34 shows the runner which race is specified. This display would appear within 1/100 second after the runner selects a race total quantity, TD, by operating the first switch 30.

If the subroutine determines that the race is underway, it increments the elapsed time quantity, T, and the slit time, ST, by 1/100 second and displays the elapsed time quantity, T, the most recent split time, MRST, and the race finishing time, RFT, on the display face. Again, even greater amounts of information and variables may be displayed on the screen 34, allowing the runner to track and evaluate progress and target times and distances. For example, certain immediately previous split times, ST, could be displayed. In another embodiment, the screen 34 may display the most recent split time, MRST, for only a limited period, for example five seconds, and then display the split time, ST, as it is accumulating. Finally, the program increments the time-of-day, TOD, variable by 1/100 second, even though the time-of-day, TOD, is not typically being displayed during the race.

The time computing device 10 may have different models for difference countries or regions having different units of time and distance measurement. Alternatively, the central control mechanism 14 may be capable of performing conversions between different units of measurement. For example, the central control mechanism 14 may be able to convert between the English and metric measurement systems.

While the preferred embodiment of the present invention uses the manual operation of the second switch 32 to signal the distance attained for each split distance increment, SDI, it is envisioned that the time computing device 10 may incorporate Global Positioning System (GPS) programs, which would use the actual progress of the runner in providing regular displays of pace, speed, elapsed time quantity, T, and race finishing time, RFT. GPS circuitry could be added to the device 10 using methods well known in the art. This would permit the determination of the runner's position at any time during the race. This input, made available to the central control mechanism 14, and used by modified logic in the read only memory 20, could be used to determine the runner's pace at any point in the race and, with straightforward modification of the formula discussed in detail above, allow a calculation of the predicted race finishing time, RFT.

In this manner, the present invention provides a time computing device 10 and predictive method for determining the predicted race finishing time, RFT, for a runner engaged in the race. The device and method are accurate predictors of the most valuable piece of information to a runner. Further, the present invention allows a device to perform calculations typically done in the runner's head.

In employing the present time computing device 10, a runner would use one of the operating switches (30, 32) to scroll through the set of conventional race distances to reach the distance about to be run. The runner, at the instant the race started, would operate the other operating switch (30, 32) as he begins the run. When the first split time, ST, is reached, he would operate this second operating switch (30, 32) again. The device 10 would then display to the runner his pace for the first split time, ST, and his predicted race finishing time, RFT, for the entire race. As the next and succeeding split times, ST, are reached, the second operating switch (30, 32) is again operated and the displays of the most recent split time, MRST, and updated predicted race finishing time, RFT, are displayed.

This invention has been described with reference to the preferred embodiments. Obvious modifications and alterations will occur to others upon reading and understanding the preceding detailed description. It is intended that the invention be construed as including all such modifications and alterations.

What is claimed is:

1. A computer-implemented predictive method for determining a race finishing time, RFT, while a runner is running a race, including the steps of:

(a) setting a race total distance quantity, TD;

(b) setting a split distance increment, SDI;

(c) actuating a running timer mechanism, outputting an elapsed time quantity, T;

(d) inputting a split number quantity, SN, upon reaching a split distance increment, SDI;

(e) computing a split time, ST, for each split number quantity, SN, at each split distance increment, SDI, based upon the elapsed time quantity, T;

(f) calculating an average split time, AST, based upon the elapsed time quantity, T, and the split number quantity, SN;

(g) setting a most recent split time, MRST, equal to the split time, ST;

(h) calculating a predicted split time, PST, based upon at least one of the average split time, AST, and the most recent split time MRST; and (i) predicting the race finishing time, RFT, based upon the total distance quantity, TD, the split distance increment, SDI, an elapsed time quantity, T, the split number quantity, SN, and at least one of the predicted split time, PST; and the average split time, AST;

wherein the race finishing time, RFT, is determined without the input of any runner physiological data.

2. The predictive method of claim 1, wherein the race finishing time, RET, is calculated using the formula:

$$RFT=T+\{[TD-(SN-1)\times SDI]\times(PST/SDI)\}.$$

3. The predictive method of claim 1, wherein the race finishing time, RFT, is predicted by weighting the most recent split time, MRST, in computing the predicted split time, PST.

4. The predictive method of claim 3, further comprising the steps of:

increasing the split number quantity, SN, by 1 for each successive split distance increment, SDI, achieved; and setting the most recent split time, MRST, for the successive split number quantity, SN;

setting a weighting factor, WF; and computing an average split time, AST, wherein the predicted split time, PST, is calculated using the formula:

$$PST=[(WF\times AST)+MRST]/(WF+1).$$

5. The predictive method of claim 1, further comprising the step of:

increasing the split number quantity, SN, by 1 for each successive split distance increment, SDI, achieved;

wherein the predicted split time, PST, is equal to an average split time, AST; and wherein the average split time, AST, is calculated using the formula:

$$AST=T/(SN-1).$$

6. The predictive method of claim 1, wherein the race finishing time, RFT, is calculated utilizing a curve-fitting logic, whereby at least one of a runner's pace for the remainder of the race and a race finish time, RFT, is predicted.

7. The predictive method of claim 1, wherein the race total distance quantity, TD, is one of user-selectable, configurable and predetermined.

8. The predictive method of claim 1, wherein the split distance increment, SDI, is one of user-selectable, configurable and predetermined.

9. A time computing device, comprising:

an actuator mechanism configured to actuate a timer mechanism, outputting an elapsed time quantity, T, and provide at least one selection input corresponding to one of a race total distance quantity, TD, and a split number quantity, SN;

a central control mechanism in communication with the actuator mechanism and configured to set a split distance increment, SDI, and, while a runner is running a race, compute:

(i) a split time, ST, for each split number quantity, SN, at each split distance increment, SDI, based upon the elapsed time quantity, T;

(ii) an average split time, AST, based upon the elapsed time quantity, T, and the split number quantity, SN;

(iii) a most recent split time, MRST, based upon the current split time, ST;

(iv) a predicted split time, PST, based upon at last one of the average split time, AST, and the most recent split time, MRST; and (v) a predicted race finishing time, RFT, based upon the total distance quantity, TD, the split distance increment, SDI, the elapsed time quantity, T, the split number quantity, SN, and at least one of the predicted split times, PST, and the average split time, AST, a display mechanism in communcation with the central control mechanism and configured to visually display at least one of actuator mechanism inputs and computational results;

wherein the race finishing time, RFT, is determined without the input of any runner physiological data.

10. The time computing device of claim 9, further comprising a driver mechanism configured to facilitate communication between the central control mechanism and the display mechanism.

11. The time computing device of claim 9, wherein the race total distance quantity, TD, is presented to a user on the display mechanism in a user-selectable race-identified menu format.

12. The time computing device of claim 11, wherein the menu displays race-identified choices selected from the group consisting of 5 kilometers, 5 miles, 10 kilometers, 15 kilometers, half-marathon and marathon.

13. The time computing device of claim 9, wherein the race total distance quantity, TD, is one of user-selectable, configurable and predetermined.

14. The time computing device of claim 9, wherein the split distance increment, SDI, is one of user-selectable, configurable and predetermined.

15. The time computing device of claim 9, wherein the timer mechanism is configured to output at least one of a time-of-day value and date value to the display mechanism via the central control mechanism.

16. The time computing device of claim 9, wherein the display mechanism visually displays at least one of a user-selectable menu, a time-of-day value, a date value, a race variable, the elapsed time quantity, T, the race total distance quantity, TD, the split number quantity, SN, the split distance increment, SDI, the split time, ST, the average split time, AST, the predicted split time, PST, a most recent split time, MRST, and the predicted race finish time, RFT.

17. The time computing device of claim 9, wherein the race finishing time, RET, is calculated using the formula:

$$RFT=T+\{[TD-(SN-1)\times SDI]\times(PST/SDI)]\}.$$

18. The time computing device of claim 9, wherein the race finishing time, RFT, is predicted by weighting the most recent split time quantity, MRST, in computing the predicted split time, PST.

19. The time computing device of claim 9, wherein the split number quantity, SN, is increased by 1 for each successive split distance increment, SDI, achieved; a most recent split time, MRST, is set for the successive split number quantity, SN; a weighting factor, WF, is set; an average split time, AST, is computed; and the predicted split time, PST, is calculated using the formula:

$$PST=[(WF\times AST)+MRST]/(WF+1).$$

20. The time computing device of claim 9, wherein the split number quantity, SN, is increased by 1 for each successive split distance increment, SDI, achieved, the predicted split time, PST, is equal to an average split time, AST, and the average split time, AST, is calculated using the formula:

$$AST=T/(SN-1).$$

21. The time computing device of claim 9, wherein the race finishing time, RFT, is calculated utilizing a curve-fitting logic, whereby a runner's pace for the remainder of the race is predicted.

22. The time computing device of claim 9, wherein the actuator mechanism is configured to allow a user to set and modify at least one of a time-of-day value and a date value via the central control mechanism.

23. The time computing device of claim 9, wherein the device is in the form of one of a wristwatch, a stopwatch, a clock, a hand-held computing device and a portable computing device.

24. The time computing device of claim 9, wherein a runner's position is determined from a global positioning system mechanism in communication with the time computing device.

25. The time computing device of claim 9, wherein the central control mechanism is configured to perform conversions between at least two different units of measurement.

26. The time computing device of claim 25, wherein the units of measurement are one of English and metric.

* * * * *

UNITED STATES PATENT AND TRADEMARK OFFICE

CERTIFICATE OF CORRECTION

PATENT NO. : 6,909,671 B2
DATED : June 21, 2005
INVENTOR(S) : Charles G. Setler

It is certified that error appears in the above-identified patent and that said Letters Patent is hereby corrected as shown below:

Column 9,
Line 61, "RET, is calculated" should read -- RFT, is calculated --.

Column 11,
Line 34, "RET, is calculated" should read -- RFT, is calculated --.

Signed and Sealed this

Third Day of January, 2006

JON W. DUDAS
*Director of the United States Patent and Trademark Office*